US005936214A

United States Patent [19]

Phillips

[11] Patent Number: 5,936,214

[45] Date of Patent: Aug. 10, 1999

[54] APPARATUS FOR RESTRICTING OPERATION OF PUSH BUTTONS ON ELECTRIC SWITCHING APPARATUS

[75] Inventor: Norman Joseph Phillips, Pittsburgh, Pa.

[73] Assignee: Eaton Corporation, Cleveland, Ohio

[21] Appl. No.: 09/074,232

[22] Filed: May 7, 1998

[51] Int. Cl.[6] ..... H01H 13/04

[52] U.S. Cl. ..... 200/43.22; 200/43.18; 174/67

[58] Field of Search ..... 174/50, 50.51, 174/52.1, 66, 67; 200/43.01, 42.01, 43.16–43.22, 518, 552, 293, 296; 361/600, 627, 628, 631, 641, 643, 644, 647, 679, 837

[56] References Cited

U.S. PATENT DOCUMENTS

| | | | |
|---|---|---|---|
| 4,017,771 | 4/1977 | Baumann | 361/357 |
| 4,979,634 | 12/1990 | Begley | 220/242 |
| 5,148,348 | 9/1992 | White | 361/356 |
| 5,401,904 | 3/1995 | Greenier, Jr. | 174/67 |
| 5,486,664 | 1/1996 | Lamp et al. | 200/297 |
| 5,555,157 | 9/1996 | Moller et al. | 361/683 |
| 5,822,192 | 10/1998 | Hayashi | 361/752 |

*Primary Examiner*—Michael A. Friedhofer
*Attorney, Agent, or Firm*—Martin J. Moran

[57] ABSTRACT

Access is restricted to the push buttons on electrical switching apparatus by a device which includes panel members hingedly mounted in a frame secured to the switch over the push buttons. The panels can be locked in the closed position over the respective push buttons by inserting a locking device through moveable staples molded on the panel members which align with a fixed staple molded on the frame between the panel members. A catch on the underside of the fixed staple is engaged by catch ledges on the panel members to retain the panel members in the closed position without locking. The transparent panel members have apertures too small for a finger, but through which a push button can be actuated by a tool with the panel member closed.

11 Claims, 4 Drawing Sheets

FIG. 4
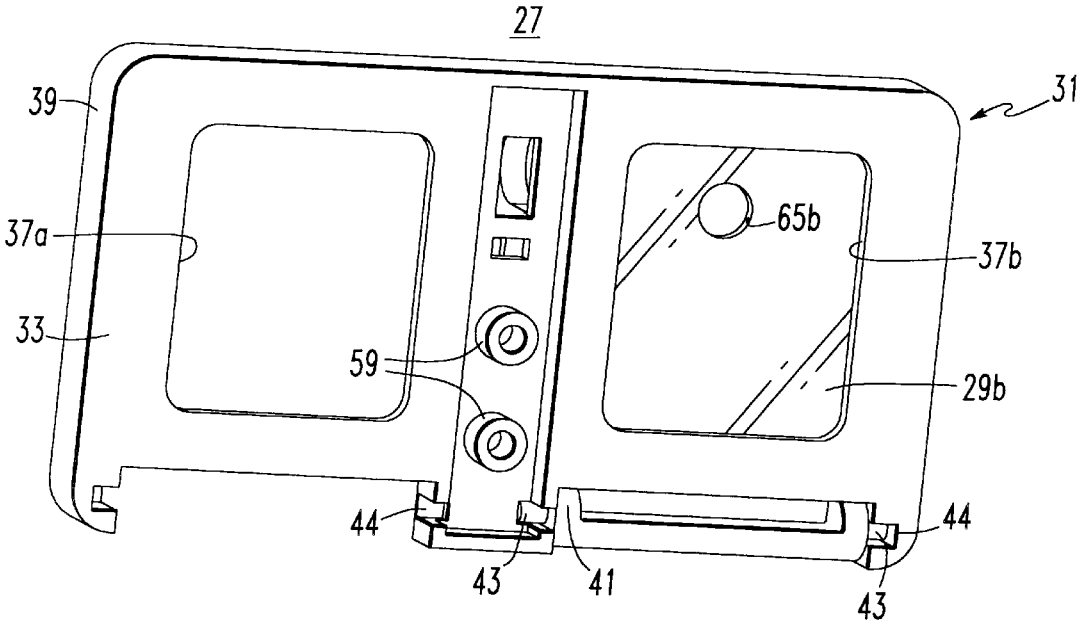
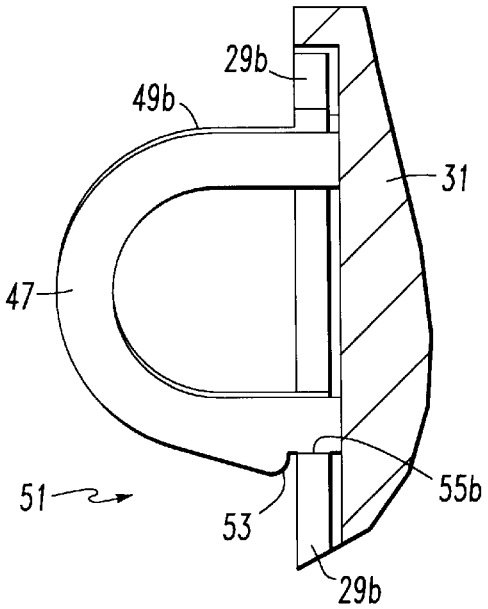
FIG. 6

APPARATUS FOR RESTRICTING OPERATION OF PUSH BUTTONS ON ELECTRIC SWITCHING APPARATUS

The Government has rights in this invention under Government Contract Number N61331-94-C-0078

BACKGROUND OF THE INVENTION

1. Field of the Invention

This invention relates to electrical switching apparatus, especially such apparatus as circuit breakers, network protectors and switches used in electric power circuits carrying large currents. More particularly, it relates to such apparatus with restriction of access to the push buttons used to operate the apparatus.

2. Background Information

Electrical switching apparatus for opening and closing electric power distribution circuits typically utilize an energy storage device in the form of one or more large springs to close the contacts of the device into the large currents which can be drawn in such circuits. Such electrical apparatus includes, for instance, power circuit breakers and network protectors which provide protection, and electrical switches which are used to energize and deenergize parts of the power circuit or to transfer between alternative power sources. These devices also include an opening spring or springs which rapidly separate the contacts to interrupt current flowing in the power circuit.

The operating mechanisms of these electric power switching devices include close and open push buttons which may be operated to release springs to close and open the contacts of the switch respectively. Typically, these push buttons are mounted side-by-side on the front of the apparatus. When the switching apparatus is used as a transfer switch to provide connections to alternate sources of power for an electric power distribution system, it is known to mount the switches side-by-side with a mechanical interlock which prevents having both switches closed at the same time. U.S. patent application Ser. No. 08/998,873, filed on Dec. 29, 1997, discloses such an interlock in which a slide bar mechanically blocks actuation of the close push button on one switch when the other is closed.

There are other situations where it is desirable to prevent unauthorized actuation of the push buttons of electrical switching apparatus. For instance, in some situations it is desirable not to close the switch until certain conditions have been satisfied, such as for example, that the load is turned off. Other examples include critical equipment which should not be turned off, hence access to the open push button should be controlled. In some installations the apparatus is controlled remotely through solenoids rather than the push buttons and it is desired therefore that the push buttons not be actuated. In other circumstances, the restriction of access may be just to prevent accidental actuation of the push buttons, but not to deny access. In all of these cases there can be circumstances where the push buttons should be operable despite the restricted access.

There is a need, therefore, for improved electrical switching apparatus in which access to the push buttons is restricted.

There is also a need for such apparatus in which the restriction access to the push buttons is selective.

There is a further need in some applications for the capability of overriding the restriction of access to the push buttons.

There is an additional need for such access restricting apparatus which is easily and economically manufactured and installed and retrofitted to existing equipment.

SUMMARY OF THE INVENTION

These needs and others are satisfied by the invention which is directed to electrical switching apparatus incorporating push button access restricting means which comprises a panel member, mounting means mounting the panel member over at least one push button of the operating mechanism of the switching apparatus for movement between a first position covering the push button and a second position in which the push button is uncovered. The access restricting means can also include locking means for selectively locking the panel member in the first position. Also, the mounting means preferably comprises a frame around the push button and hinge means mounting the panel member on the frame for hinged movement between the first and second positions.

The locking means may be adapted for locking the panel member in the first position such as with a padlock, sealing wire or other means. In such case, the locking means includes a fixed staple secured by the frame and a moveable staple carried by the panel member and positioned to align with the fixed staple with the panel member in the first position. The locking means can also include retaining means compliantly retaining the panel member in the first position without being locked. This retaining means can comprise a catch on the fixed staple and a catch ledge on the panel member engaging the catch when the panel member is in the first position.

Where the operating mechanism has first and second push buttons adjacent each other, the frame extends around both of the push buttons and the access restricting means comprises a first panel member and a second panel member. The mounting comprises hinge means mounting the panel members for hinged movement between the first and second positions. In this case, the locking means can comprise a common, fixed staple adjacent both panel members and moveable staples associated with each of the panel members for alignment with the common fixed staple when the respective panel member is in the first position.

The access restricting means may further include an additional panel extending across both of the push buttons and having an opening aligned with only one of the push buttons. This will permanently restrict access to one of the push buttons, although the additional panel may have a hole in it through which a small tool can be used to actuate the push button. The cross section of the hole is limited such as to about a ¼" so that a finger cannot be inserted through the opening to actuate the switch. The hinged panel members may have similar openings sized for actuation by a tool but not by a human finger.

The invention also includes the above described apparatus for restricting operation of at least one of the side-by-side close and trip push buttons on electrical switching apparatus.

BRIEF DESCRIPTION OF THE DRAWINGS

A full understanding of the invention can be gained from the following description of the preferred embodiments when read in conjunction with the accompanying drawings in which:

FIG. 4 is an isometric view from behind and to one side of the device shown in FIG. 3.

FIG. 6 is a fragmentary sectional view in enlarged scale taken along the line 6—6 in FIG. 3.

DESCRIPTION OF THE PREFERRED EMBODIMENTS

The invention is applicable to various types of electrical switching apparatus such as, for example, circuit breakers, network protectors, disconnect switches and transfer switches, having push buttons to which access is to be restricted. It can also be applied to the push buttons on contactors and motor starters. For purposes of disclosure, the invention will be described in connection with a power circuit breaker.

Figure 1:
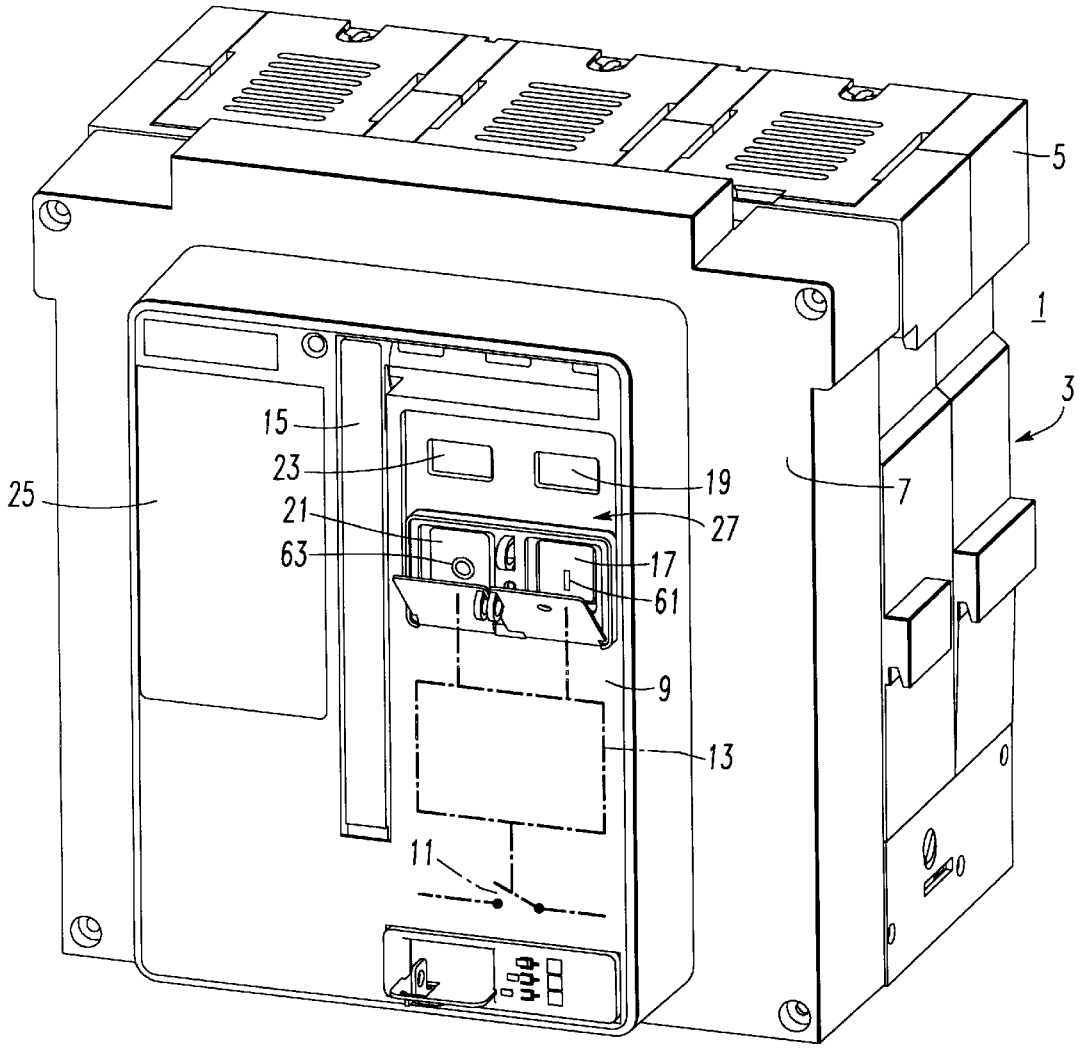
FIG. 1 is an isometric view of electrical switching apparatus incorporating the invention.

Referring to FIG. 1, the power circuit breaker 1 has a housing 3 which includes an electrically insulative molded casing 5 and a front cover 7 having an outwardly projecting section 9. As is well known, the power circuit breaker 1 includes separable contacts 11 which are opened and closed by an operating mechanism 13, both of which are shown schematically for illustrative purposes. Typically such power circuit breakers 1 are three-phase switches with separable contacts 11 for each phase controlled by a single operating mechanism 13.

The operating mechanism 13 includes one or more closing springs (not shown) which are initially charged to store energy by a handle 15, and/or a motor operator (not shown). The circuit breaker 1 also includes opening springs (not shown) which are charged by the close springs during closing and which release their energy to open the separable contacts 11.

In order to close the separable contacts 11, a close push button 17 is made accessible through the front cover 7. Pushing of the close button 17 actuates the operating mechanism 13 to release the energy stored in the close spring to close the contacts 11. An indicator 19 provides a visual indication of the charge state of the close spring.

In order to open the separable contacts 11, an open push button 21 is provided in the front cover 9. A second indicator 23 provides an indication of the open/closed state of the separable contacts 11. The separable contacts 11 can also be opened automatically by a trip unit 25 in response to selected current-time characteristics of the load current. In many applications, the circuit breaker can be remotely opened and/or closed independently of the push buttons 17, 21 and the trip unit 25.

As mentioned above, there are applications where it is desirable to restrict access to the push buttons 17, 21. In some situations, it is desirable that only authorized personnel be able to close the circuit breaker. In others, such as where the circuit breaker protects a critical load, it may be desirable to prevent unauthorized personnel from deenergizing the load by opening the circuit breaker 1. In still other applications, it may be desirable to control the circuit breaker 1 remotely and therefore restrict local opening and closing of the circuit breaker with the push buttons.

The present invention is directed to access restricting apparatus 27 which provides flexibility in restricting operation of the close push button 17 and open push button 21. Referring to FIGS. 2–6, the access restricting apparatus 27 is in the form of a molded push button cover that includes panel members 29*a* and 29*b* which are supported for hinged movement by a mount in the form of a molded frame 31. The molded frame 31 includes a planar member 33 having a pair of recesses 35*a* and 35*b* through which extend openings 37*a* and 37*b* . A flange 39 extends around the side edges and top edge of the planar member 33.

Figure 5:
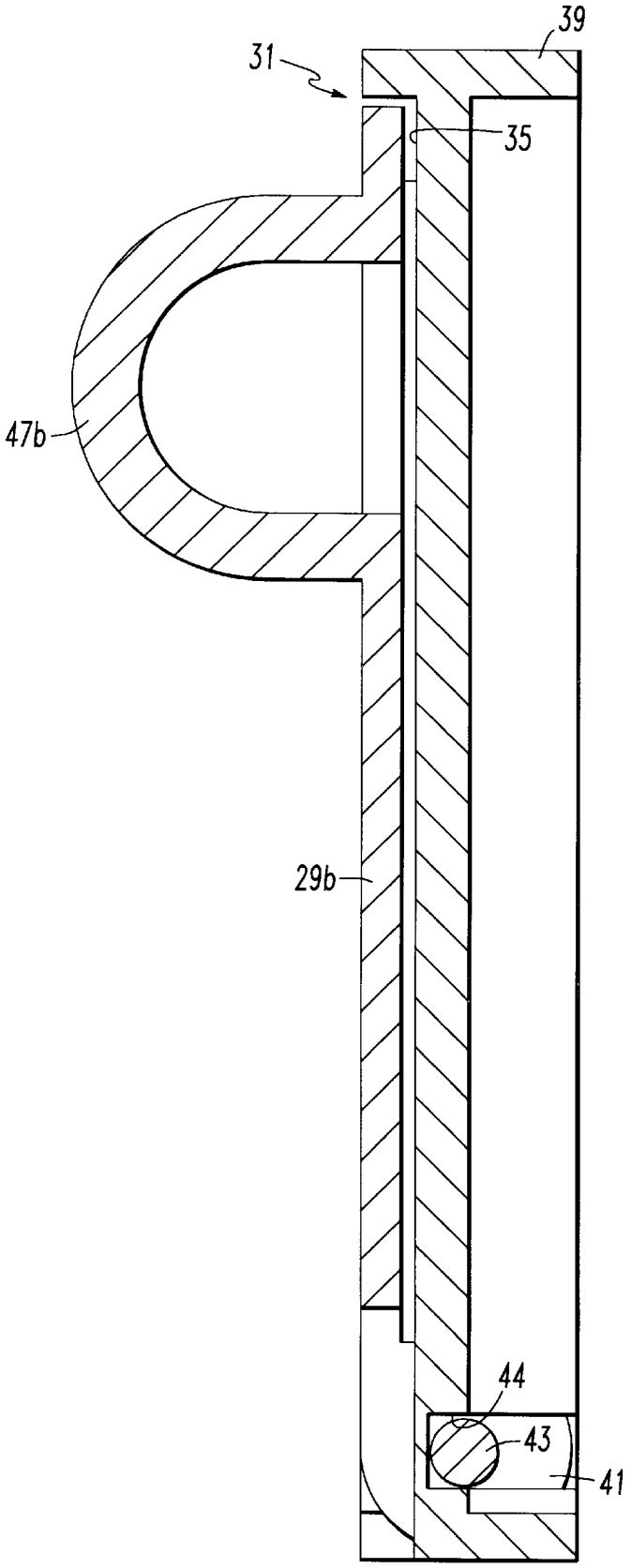
FIG. 5 is a vertical sectional view in enlarged scale taken along the line 5—5 in FIG. 3.

The panel members 29*a* and 29*b* have bosses 41 extending rearwardly at their lower corners. Pivot pins 43 extend laterally outward from the bosses 41 as best seen in FIGS. 4 and 5. These pivot pins are received in slots 44 extending forward from the rear face of the frame 31 to hingedly mount the panel members 29*a* and 29*b*.

Figure 2:
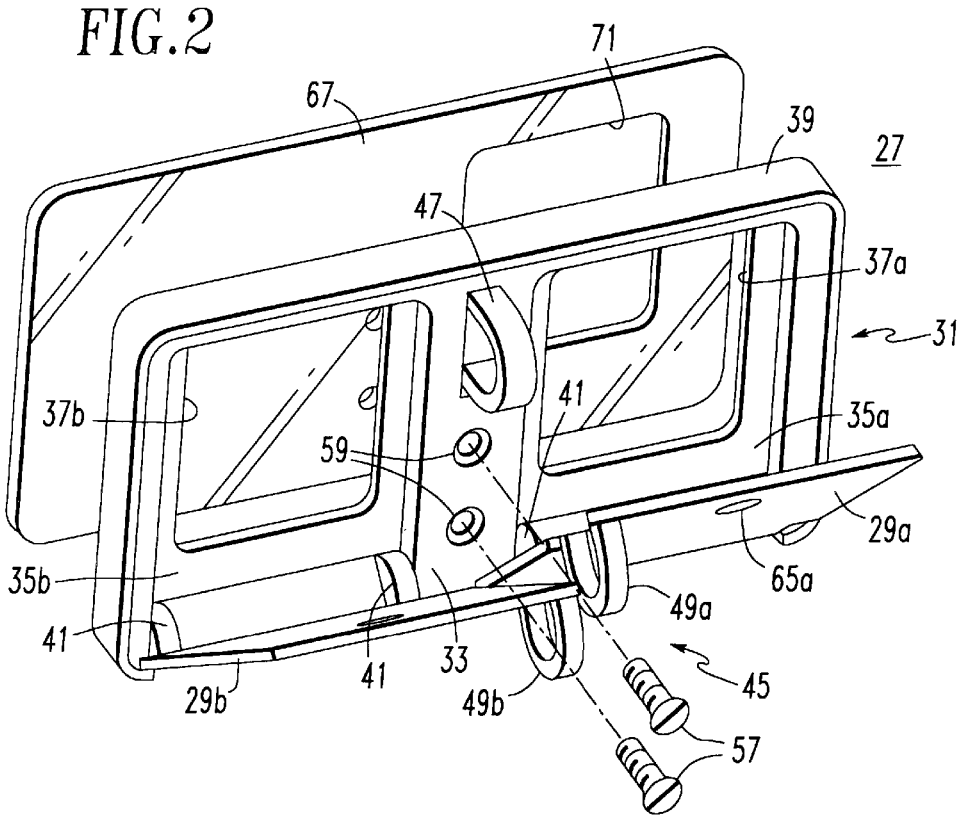
FIG. 2 is an exploded isometric view of an access restricting device in accordance with the invention.
Figure 3:
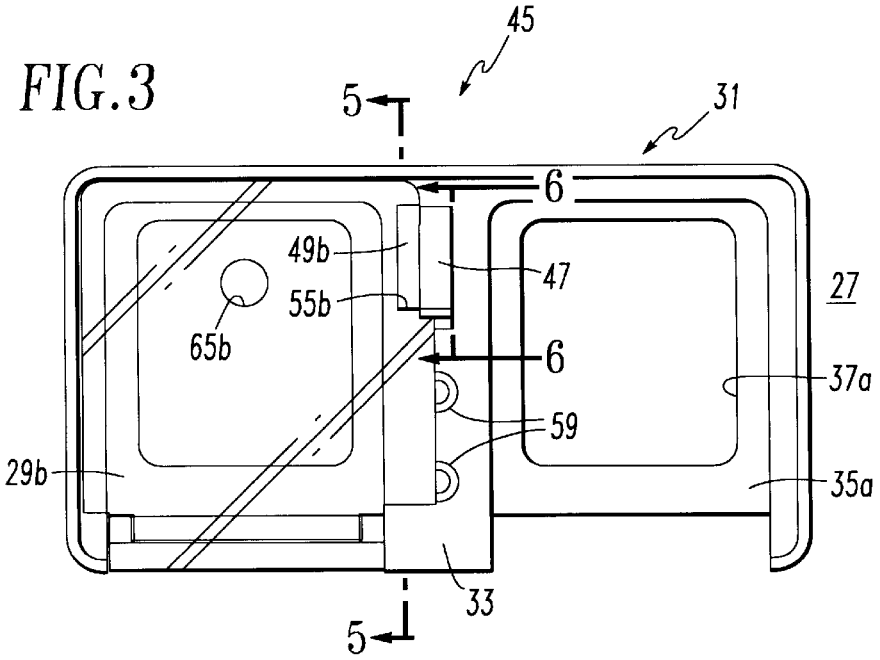
FIG. 3 is a front elevation view of the access restricting device with the right hand panel removed.

As shown in FIGS. 2, 3 and 6, the panel members 29*a* and 29*b* can be secured in a closed position covering the openings 37*a* and 37*b* by a locking arrangement 45 which includes a fixed staple 47 integrally molded to the frame 31 and projecting forward from the planar member 33 between the openings 37*a* and 37*b* . Each of the panel members 29*a* and 29*b* have an integrally molded moveable staple 49*a* and 49*b* which are aligned with the fixed staple 47 when the panel members 29*a* and 29*b* are closed. FIGS. 3–6 show the panel number 29*b* closed and the panel member 29*a* removed to illustrate other features. With the fixed and moveable staples so aligned, a locking device such as a padlock (not shown), a sealing wire (also not shown) or the like can be inserted to secure the panel members 29*a* and 29*b* in the closed position.

In some cases, it is desirable to prevent inadvertent actuation of the push buttons but not to restrict intentional actuation. Thus, a retaining device 51, as best seen in FIG. 6, includes a catch 53 in the form of a notch on the underside of the fixed staple 47. Each of the panel members 29*a* and 29*b* is provide with a catch ledge 55*a* , 55*b* adjacent to the moveable staple 49*a* and 49*b* . Due to the resilience of the molded resin panel members 29*a* and 29*b* , the position of the catch ledges 55*a* and 55*b* relative to the pivot pins 43 create interference with the forward part of the fixed staple 47 but the panel members deflect to pass through and engage the notch 53. Thus, the panel members 29*a* and 29*b* are resiliently retained in the closed position. Either panel member 29*a* or 29*b* can be opened by pulling outward on the associated moveable staple 49*a*, 49*b* which also serve as handles.

In use, the pivot pins 43 of the panel members 29*a* and 29*b* are inserted into the slots 44 in the frame 31 from the rear (see FIG. 4), and then the frame is secured to the front cover 7 of the circuit breaker 1 by a pair of screws 57 which extend though apertures 59 in the center of the planar member 33 below the fixed staple 47 (see FIG. 2). With the frame 31 secured to the front cover with the openings 37*a* and 37*b* aligned to provide access to the push buttons 17 and 21, the pivot pins 43 of the panel members 29*a* and 29*b* are captured to permit hinged movement but not removal of the panel members 29*a* and 29*b* . The panel members 29*a* and 29*b* are sized so that they abut along their common side edges when closed to prevent access to the mounting screws 57.

Typically, the push buttons 17 and 21 are provided with legends 61 and 63 indicating their function as shown in FIG. 1. Accordingly, it is preferred that the panel members 29*a* and 29*b* be transparent so that the functions of the switches can be identified even when their access is restricted by the closed panel members 29*a* and 29*b*.

As previously discussed, in some applications it is desired to prevent inadvertent operation of the switches or to limit operation to authorized personnel. Thus, the panel members 29*a* and 29*b* are provided with apertures 65*a* and 65*b* which are small enough to prevent actuation of the associated push button with a finger, but which permit actuation by a small tool. In the exemplary embodiment of the invention, these apertures 65*a* and 65*b* are no greater than about ¼" in diameter.

It was also discussed that in some applications it may be desirable to prevent actuation of one of the push buttons all together, while only restricting access to the other push button. In these situations, an additional panel 67 is mounted behind the frame 31 with the same screws 57 as shown in FIG. 2. This additional panel 67 has only one button opening 71 which can be aligned with one, and only one, of the openings 37*a* and 37*b*.

The access restricting device 27 of the invention provides an inexpensive, flexible device for restricting access to the push buttons of electrical switching apparatus. It is adaptable for use with new equipment or for retrofit to existing equipment.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. Electrical switching apparatus comprising:

a housing;

separable contacts mounted within said housing;

an operating mechanism mounted in said housing and having a first push button and a second push button adjacent said first push button; and access restricting means comprising:

a first panel member and a second panel member; and mounting means comprising a frame extending around said first push button and said second push button and hinge means mounting said first panel member and said second panel member to said frame over said first push button and second push button, respectively, for hinged movement between a first position covering the respective push button and a second position in which the respective push button is uncovered.

2. The electrical switching apparatus of claim 1 wherein said access restricting means includes locking means comprising means selectively locking at least one of said first panel member and second panel member in said first position.

3. The electrical switching apparatus of claim 2 wherein said locking means comprises a common, fixed staple adjacent both said first panel member and second panel member and moveable staples associated with each of said first and second panel members for alignment with said common fixed staple when said panel members are in the first positions.

4. The electrical switching apparatus of claim 3 wherein said panel members are transparent.

5. The electrical switching apparatus of claim 1 wherein said access restricting means further includes an additional panel extending across said first push button and said second push button and having an opening aligned with only one of said push buttons.

6. Apparatus for restricting operation of at least one of side-by-side close and trip push buttons on electric power switching apparatus, comprising:

a frame mounted around said close push button and said open push button;

a first panel member mounted on said frame for movement between a first position covering said close push button and a second position uncovering said close push button;

a second panel member mounted on said frame for movement between a first position covering said trip push button and a second position uncovering said trip push button; and locking means selectively locking at least one of said first panel member and second panel member in said first position.

7. The apparatus of claim 6 wherein said close push button and said trip push button each have a legend thereon and wherein said first panel member and second panel member are transparent.

8. The apparatus of claim 6 wherein at least one of said first panel member and second panel member has an aperture no larger than about ¼-inch across through which at least one of said close push button and said trip push button can be actuated by a tool with said at least one of said first panel member and said second panel member in said first position.

9. The apparatus of claim 6 wherein said locking means comprises a common, fixed staple secured by said frame adjacent said first and second panel members, said first panel member having an associated staple, and said second panel member having an associated staple, said common fixed staple and said associated staples being aligned with said first and second panel members in the first position.

10. The apparatus of claim 9 wherein said panel members are hingedly mounted for pivoting between said first and second positions, said common staple has a catch and said first panel member and said second panel member each have a catch ledge which engages said catch to compliantly retain said first panel member and said second panel member covering said close push button and trip push button, respectively.

11. The apparatus of claim 6 wherein said first panel member and said second panel member are hingedly mounted for pivoting between said first and second positions.

* * * * *